US006802486B2

(12) United States Patent
Weingartner

(10) Patent No.: US 6,802,486 B2
(45) Date of Patent: Oct. 12, 2004

(54) ERGONOMIC LECTERN

(76) Inventor: Peter Weingartner, Redtenbachergasse 56/33, A-1160 Wein (AT)

( * ) Notice: Subject to any disclaimer, the term of this patent is extended or adjusted under 35 U.S.C. 154(b) by 0 days.

(21) Appl. No.: 10/380,989

(22) PCT Filed: Sep. 10, 2001

(86) PCT No.: PCT/AT01/00283

§ 371 (c)(1),
(2), (4) Date: Mar. 19, 2003

(87) PCT Pub. No.: WO02/24029

PCT Pub. Date: Mar. 28, 2002

(65) Prior Publication Data

US 2003/0183738 A1 Oct. 2, 2003

(30) Foreign Application Priority Data

Sep. 20, 2000 (AT) ..... A 1595/2000

(51) Int. Cl.[7] ..... A47G 1/24

(52) U.S. Cl. ..... 248/454; 248/448; 248/451; 248/372.1

(58) Field of Search ..... 248/454, 446, 248/447, 448, 449, 451, 453, 457, 458, 465.1, 456, 371, 372.1

(56) References Cited

U.S. PATENT DOCUMENTS 550,180 A * 11/1895 Kullberg et al. ..... 248/454
1,923,351 A * 8/1933 Woodley ..... 248/456
2,255,632 A * 9/1941 Stevens ..... 248/454
2,572,731 A * 10/1951 Keith ..... 248/457
3,193,240 A * 7/1965 Browett ..... 248/449
3,562,796 A * 2/1971 Jacobson ..... 248/456
3,952,989 A 4/1976 Bannister Hatcher
3,954,246 A * 5/1976 Sparkman ..... 248/453
3,991,967 A * 11/1976 Sack ..... 248/448
4,436,271 A * 3/1984 Manso ..... 248/460
5,170,983 A * 12/1992 Stewart ..... 248/558
5,797,578 A 8/1998 Graffeo
5,979,940 A * 11/1999 Araghi ..... 281/45

* cited by examiner

*Primary Examiner*—Leslie A. Braun
*Assistant Examiner*—Naschica S. Morrison
(74) *Attorney, Agent, or Firm*—Darby & Darby

(57) ABSTRACT

An ergonomic reading stand for holding books, catalogs, etc. consists of a right and left support, a bracket, a pivoting shaft with knurled screws and a base. The slant of the book can be variably adjusted by releasing the knurled screws (on both ends of the pivoting shaft) and by displacing the shaft forwards or backwards, in relation to the base. Threaded pins for adjusting the sliding resistance that is generated when the pivoting shaft is displaced are provided on the underside of the pivoting shaft, below the right and left slide bearing. The bracket is used to hold down the book pages and can be adjusted to the thickness of the book by a displacement parallel to the lower bearing surface. The bracket can be pressed down to enable the pages to be turned rapidly. After the bracket has been released, it springs back into its original position.

2 Claims, 5 Drawing Sheets

ERGONOMIC LECTERN

This is a U.S. national phase application under 35 U.S.C. §371 of International Patent Application No. PCT/AT01/00283 filed Sep. 10, 2001, and claims benefit of Austrian Patent Application No. A 1595/00 filed Sep. 20,2000. The International Application was published in German on Mar. 28, 2002 as WO 02/24029 Al under PCT Article 21(2).

TECHNICAL FIELD

The invention concerns a lectern for books, catalogs, tables, etc.., comprising a base 11 with two supporting arms for a tilt-adjustable book support 1 and page hold-down device 15.

BACKGROUND

There is no ergonomic lectern for office desks or for homes. It is possible to obtain wooden lecterns, standing lecterns, illuminated lecterns, devices for spreading out A4 sheets, documents, fragile plastic book stands, etc. . .

These designs, which are not very sophisticated technically, do not allow either ergonomic stepless adjustment of the tilt of the book, nor satisfactory adjustment of the hold-down depth for any book thickness. No attempt at an ergonomically acceptable means for turning pages can be found among existing lecterns.

SUMMARY

The invention is aimed at an ergonomic lectern for standing and sitting persons.

This objective is attained according to the invention by the fact that the supporting arms of the base 11 have ends curved into arcs, on which a horizontal axle assembly 3 is arranged so that it can slide, and which carries the book support 1, which is designed as an L-shaped profile, and by the fact that the loop 15 can pivot in the axis and is mounted so that it can be slid in and out radially relative to the axle assembly.

BRIEF DESCRIPTION OF THE DRAWING FIGURES

The invention is explained in more detail by means of the drawings.

Figure 6:
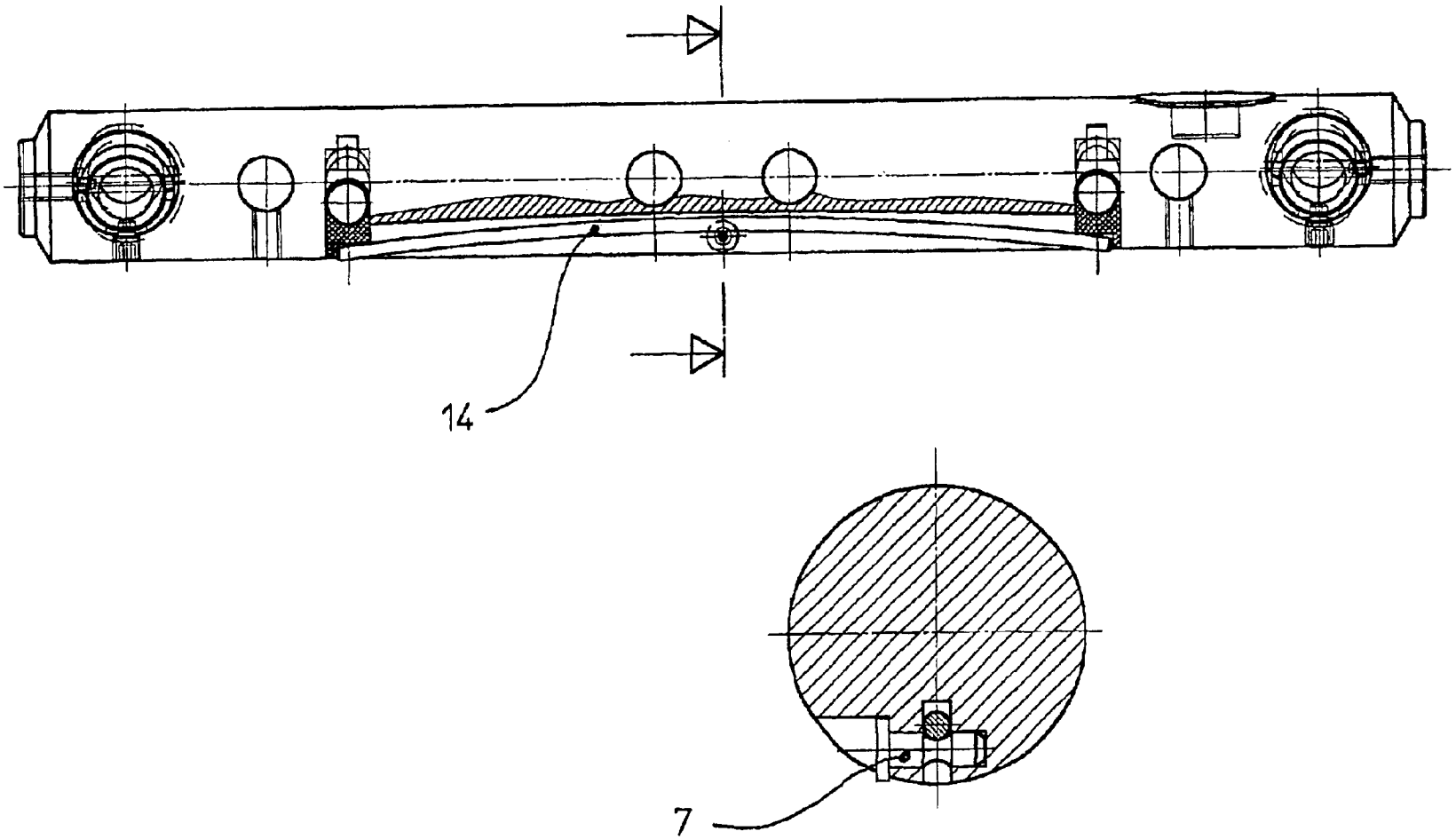

FIG. 6 shows the interrupted axle 3 with the spring rod 14 and safety bolt 7.

DETAILED DESCRIPTION OF PREFERRED EMBODIMENTS

The lectern is made of polyamide, rubber, and aluminum and steel alloy parts. The load-carrying parts (base, axle, support and loop) are made of high-alloy aluminum. The sliding bearings (guide tube, sliding pieces) are of polyamide. The knurled screws and shims are steel, and the cushion is rubber.

The guide tube 5, the position of which is defined by a lateral piece that fits together with the two support shells 4, is inserted radially, along with them and with the shim 8 and the safety ring 6, into the axle 3. The shim 8 is forced directly into the guide tube from the side. This group is fixed in the hole of axle 3 by a screw in the journal 10, which is screwed radially into the underside of the axle and is secured against rotation by the safety ring 6.

Two sliding pieces 2, 17 are likewise introduced from below, radially, into a transverse slot in the axle 3. The upper sliding piece 2 is pressed into the axle, while the lower sliding piece 17 is forced radially upward by a spring rod 14 mounted in a longitudinal slot in the axle. The spring rod 14 is prestressed and secured by a safety bolt 7 having a circular slot, which is inserted horizontally into the axle from the back. The prestressed spring rod in turn secures the safety bolt against shifting axially by snapping into its circular slot (FIG. 6, 5/5). The right and left supports 1 are inserted radially into the axle 3 on the front side and are fastened against the axle with four screws 13. A plate 16 is clamped in each of the right and left supports. The loop 15 is introduced from the front, with both ends horizontal, into the passages of the two sliding pieces 2, 17. Knurled screws 9 are screwed into both ends of the axle.

Rubber cushions 12 are pressed into four mounting points in the bottom of the base.

Figure 1:
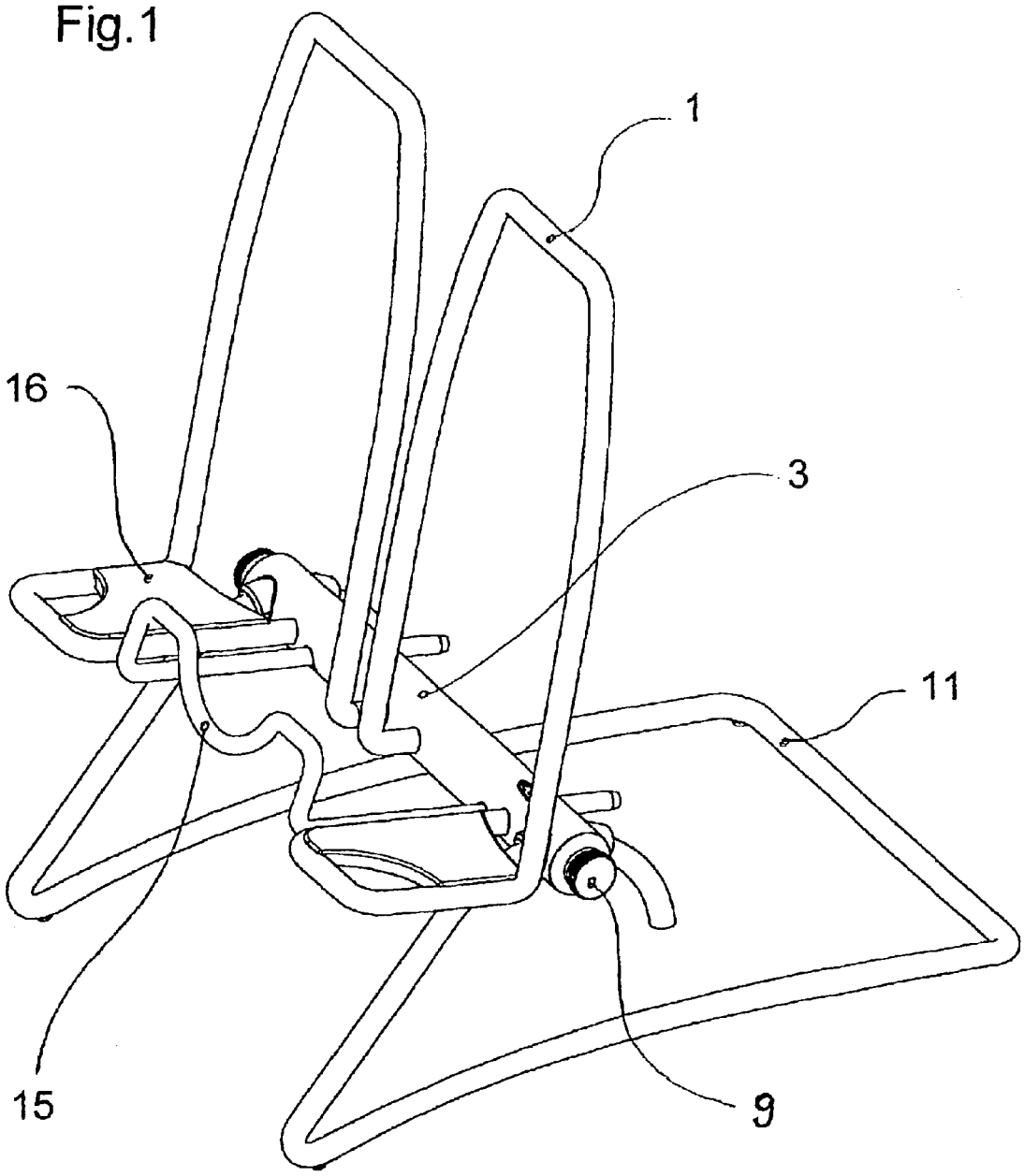
FIG. 1 shows an oblique view of a lectern according to the invention.
Figure 2:
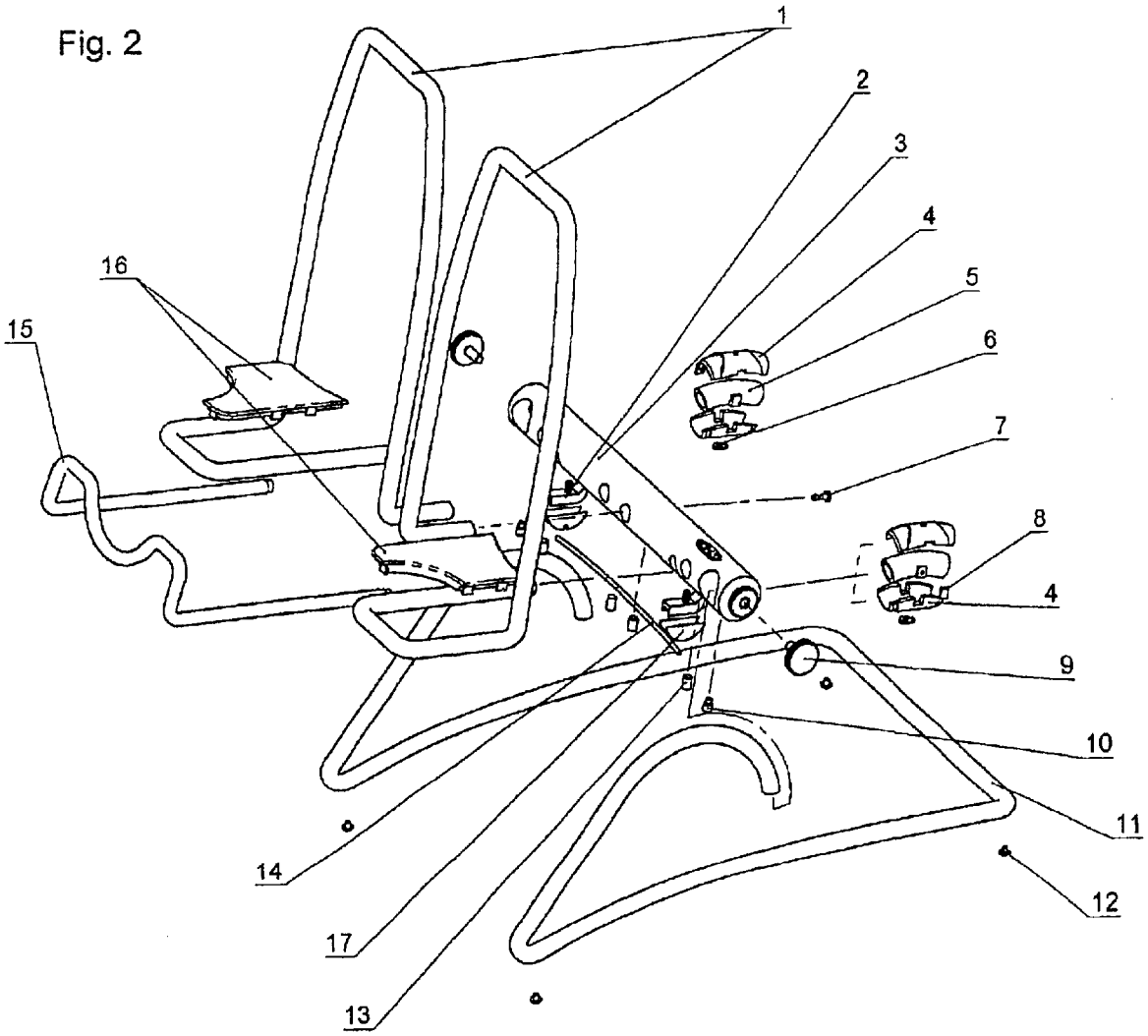
FIG. 2 shows an exploded view of the lectern.
Figure 3:
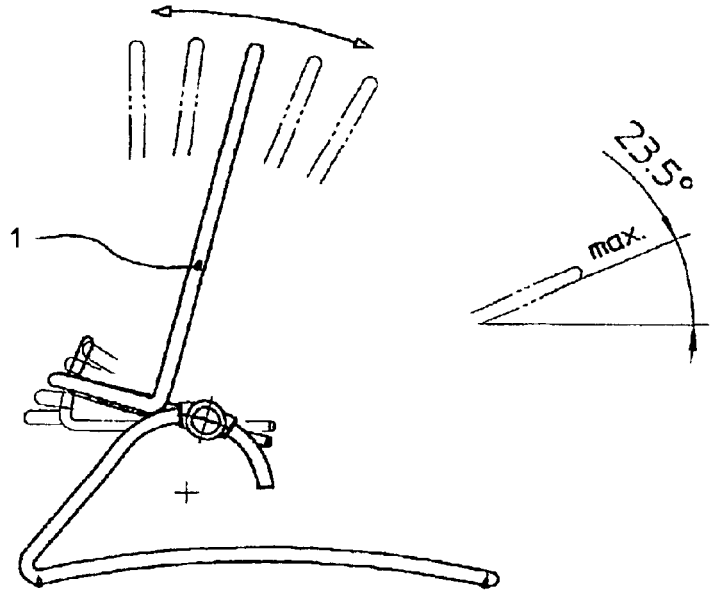
FIG. 3 shows adjustment of the tilt of the book support 1.
Figure 4:
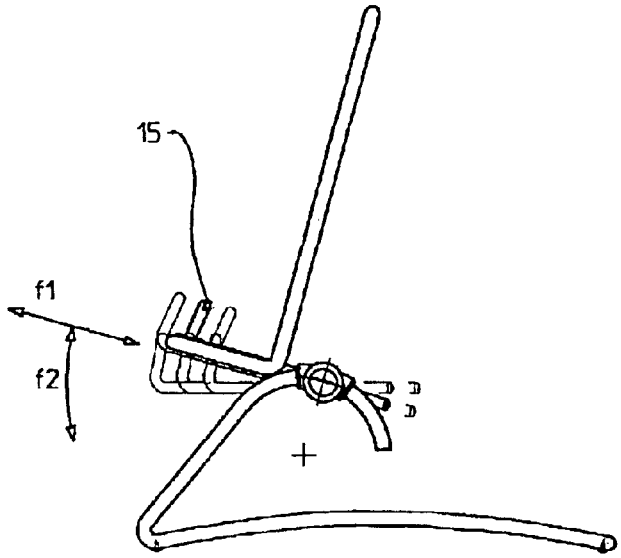
FIG. 4 shows adjustment of the page hold-down device 15 to match the thickness of the book (f1) and movement of the page hold-down device to turn pages (f2).

The book (magazine, catalog, table, etc. . . ) is placed centrally on the right and left supports. The loop 15, which is pressed parallel to the short front support surface by the force of the prestressed spring rod 14 on the four sliding pieces 2, 17, can now be slid transversely to the axle 3, depending on the thickness of the book (see 3/5, FIG. 4 f1). Turning the pages is made possible by pressing down on the loop (see 3/5, FIG. 4 f2). Due to the geometry of the sliding pieces 2, 17, that assures that the loop returns to its original position when the spring forces it back.

The prestressed spring rod 14, secured by a safety bolt 7, presses the lower sliding piece 17 against the loop, and also prevents it from shifting by a form-fitting connection. The angle set for the support 1 is fixed with the two knurled screws 9. The steel shim 8 pressed into the guide tube 5 prevents the knurled screws from deforming the guide tube. The tilt of the book can now be adjusted smoothly by loosening the two knurled screws.

Figure 5:
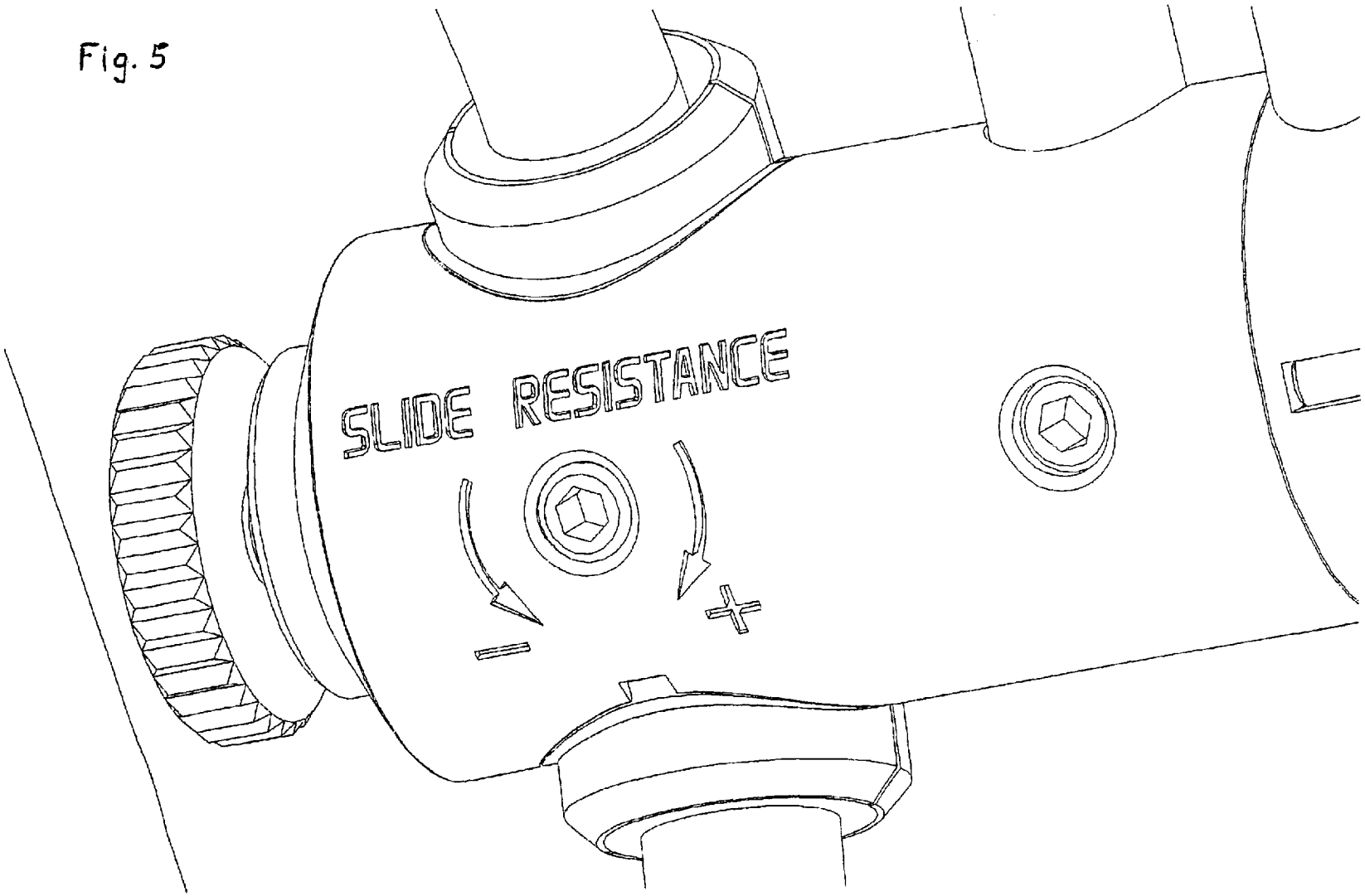
FIG. 5 shows the screw 10 for changing the resistance to sliding, which affects the shifting of the book holder 1.

The special design of the curved polyamide guide tubes 5, which act as sliding bearings, makes it possible to adjust the tilt of heavy books (up to 4.5 kg) smoothly without the need to hold or touch the book. The screw 10 with its journal secures the support shells 4 to the guide tube in the axle, and can also, by means of that, change the sliding resistance which acts on the adjustment of the support angle (see 4/5, FIG. 5).

The pressure of the screw with its journal 10 is distributed through the lower support shell 4 over the entire length of the guide rod 5. That results in an even change of its cross section. The smoothly adjustable angle of the support, from about 30° to 100°, makes it possible for the reader to see the book easily, even when standing.

What is claimed is:

1. A lectern comprising:

base with two support arms, a tilt-adjustable L-shaped book support with a pivotally supported page hold-down device, and a horizontal axle assembly, wherein the support arms have arc-shaped ends on which the axle assembly is slidably supported, and wherein the page hold-down device is supported by the axle assembly with mobility to pivot relative to the axle assembly and to slide in and out in a direction radial to the axle assembly, wherein the axle assembly is slidable on said arc-shaped ends by means of slide bushings, and wherein a resistance to sliding of the axle assembly on said arc-shaped ends is adjustable by means of adjustment screws.

2. The lectern of claim 1, wherein the page hold-down device comprises two legs, each held by an upper slide-bearing shell and a lower slide-bearing shell, wherein all of said slide-bearing shells are mounted inside the axle assembly, the lower slide-bearing shells being pushed against said legs by an elastically pre-stressed spring rod.

* * * * *